United States Patent [19]

Opsvik

[11] Patent Number: 4,607,882

[45] Date of Patent: Aug. 26, 1986

[54] CHAIR WITH SADDLE SHAPED SEAT AND MEMBERS EXTERNALLY TRANSVERSELY THEREFROM

[76] Inventor: Peter Opsvik, Hogtunvn. 12, N-1370 Asker, Norway

[21] Appl. No.: 678,710

[22] Filed: Dec. 6, 1984

[30] Foreign Application Priority Data

May 8, 1984 [NO] Norway ..... 841844

[51] Int. Cl.[4] ..... A47C 7/31

[52] U.S. Cl. ..... 297/195; D6/346; D6/354; 297/458; 297/460; 297/418

[58] Field of Search ..... 297/175, 427, 458, 459, 297/464, 283, 418, 466, 467, 460; D6/346, 354

[56] References Cited

U.S. PATENT DOCUMENTS

| | | | |
|---|---|---|---|
| D. 180,133 | 4/1957 | Benson | D6/354 |
| D. 223,980 | 6/1972 | Fritz et al. | D6/354 |
| 454,100 | 6/1891 | Wilson | 297/195 X |
| 557,132 | 3/1896 | Prease | 297/195 |
| 2,364,050 | 12/1944 | Benson | 297/195 X |
| 3,754,787 | 8/1973 | Garber | 297/195 X |

FOREIGN PATENT DOCUMENTS

| | | | |
|---|---|---|---|
| 356291 | 9/1905 | France | 297/195 |
| 1180530 | 2/1970 | United Kingdom | 297/195 |

*Primary Examiner*—Peter A. Aschenbrenner
*Attorney, Agent, or Firm*—Darby & Darby

[57] ABSTRACT

A chair provided with a seat and a back rest, said seat (1) having a general saddle shape, a saddle-like member (2,3) projecting out from a mid part of each longitudinal side of said saddle shaped seat to support the rear, upper thigh portion of a chair user. The back rest (4) has a comparatively narrow, upwardly directed mid portion (5), and two branches (6, 7) projecting laterally therefrom, and intended to be used for elbow and/or forearm support. The chair can be used for sitting posture in both directions, i.e. facing away from or facing the back rest. In either of these sitting postures, the chair occupant can assume a sitting posture with a large open angle between the upper part of the body and the thigh section, the sitting posture then approaching that of a kneeling-like sitting posture.

20 Claims, 4 Drawing Figures

CHAIR WITH SADDLE SHAPED SEAT AND MEMBERS EXTERNALLY TRANSVERSELY THEREFROM

The present invention relates to improvements of a chair provided with a seat and a back support.

During recent years, there has been a certain focusing on the so-called kneeling-like sitting posture, also denoted BALANS® alternative sitting posture. This sitting posture has focused on as wide as possible angle between the upper part of the body and the thigh portion simultaneously with the provision of supporting means for the shins of the chair user. Further, there has been a need for a chair in which the user is capable of turning 180° in said chair in order to obtain a comfortable position of rest providing a good support of the forearms.

The said two needs, viz. a kneeling-like sitting posture and the possibility of turning 180° on the chair is difficult to provide with a chair seat known per se, as a kneeling-like sitting posture yields that the seat must have a certain inclination, and necessitates supporting cushions for the shins of the chair user, in order to prevent the user to slide off the seat.

With the present invention it is intended to provide a chair enabling the said multiple use, simultaneously with the need for a shin support being avoided.

The characterizing features of the invention will appear from the attached patent claims and from the description below with reference to the enclosed drawing figures illustrating a preferred, but non-limitative embodiment.

Figure 1:
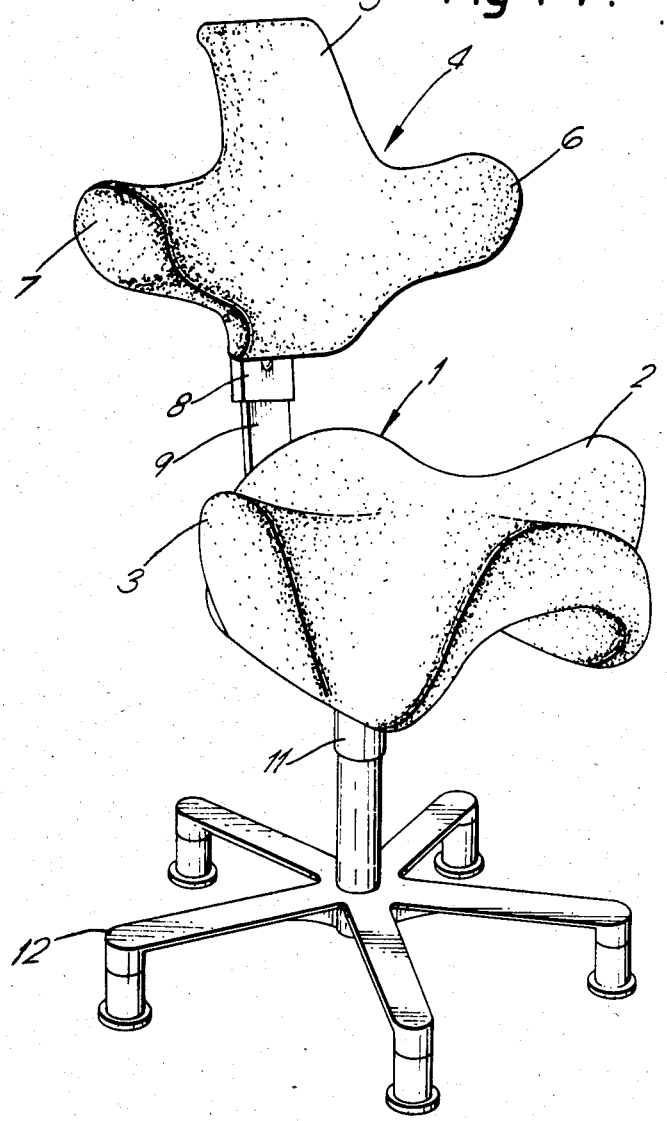
FIG. 1 is a front perspective view of the chair.
Figure 3:
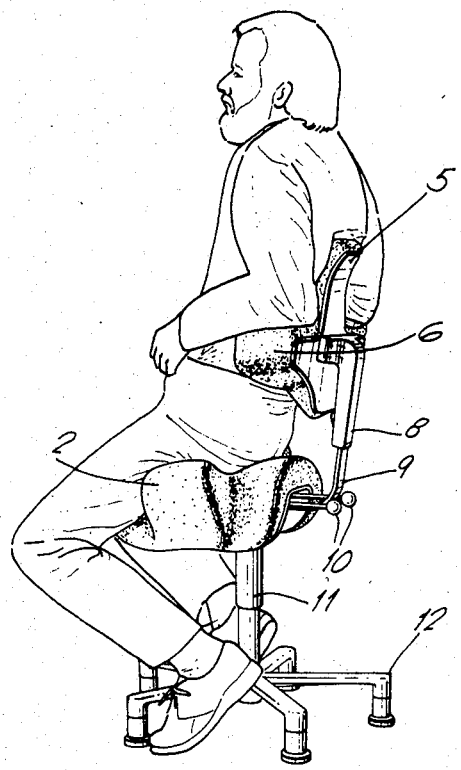
FIG. 3 illustrates the use of the chair with the chair occupant facing in the forward direction.

In FIG. 1 the seat 1 has in its longitudinal direction a general saddle shape. From midportions of the longitudinal sides of the seat 1 saddle-like members 2,3 project and are intended to support the rear upper thigh portion of the chair user, as will clearly appear from FIGS. 3 and 4. The back rest 4 of the chair comprises a relatively narrow upward middle section 5 and two branches 6, 7 extending laterally therefrom, said branches 6, 7 serving as elbow/forearm support in the two sitting postures being clearly illustrated in FIGS. 3 and 4. By making the said mid portion 5 comparatively narrow, the chair user will inherently pull the shoulder region somewhat rearward, which will cause an improved posture of his/her back. In the two sitting postures disclosed in FIGS. 3 and 4, the chair user will obtain a quite open angle, e.g. in the range 100°–150° between the upper part of the body and the thigh portion simultaneously with the knees being bent, contrary to a conventional chair, where the angle between the upper part of the body and the thigh portion normally is approximately 90°. The sitting postures thus made available with the present chair provide several of the inherent advantages offered by the said wider angle between the upper part of the body and the thigh portion, simultaneously with the legs (including shins) to a large extent being readily movable.

Figure 2:
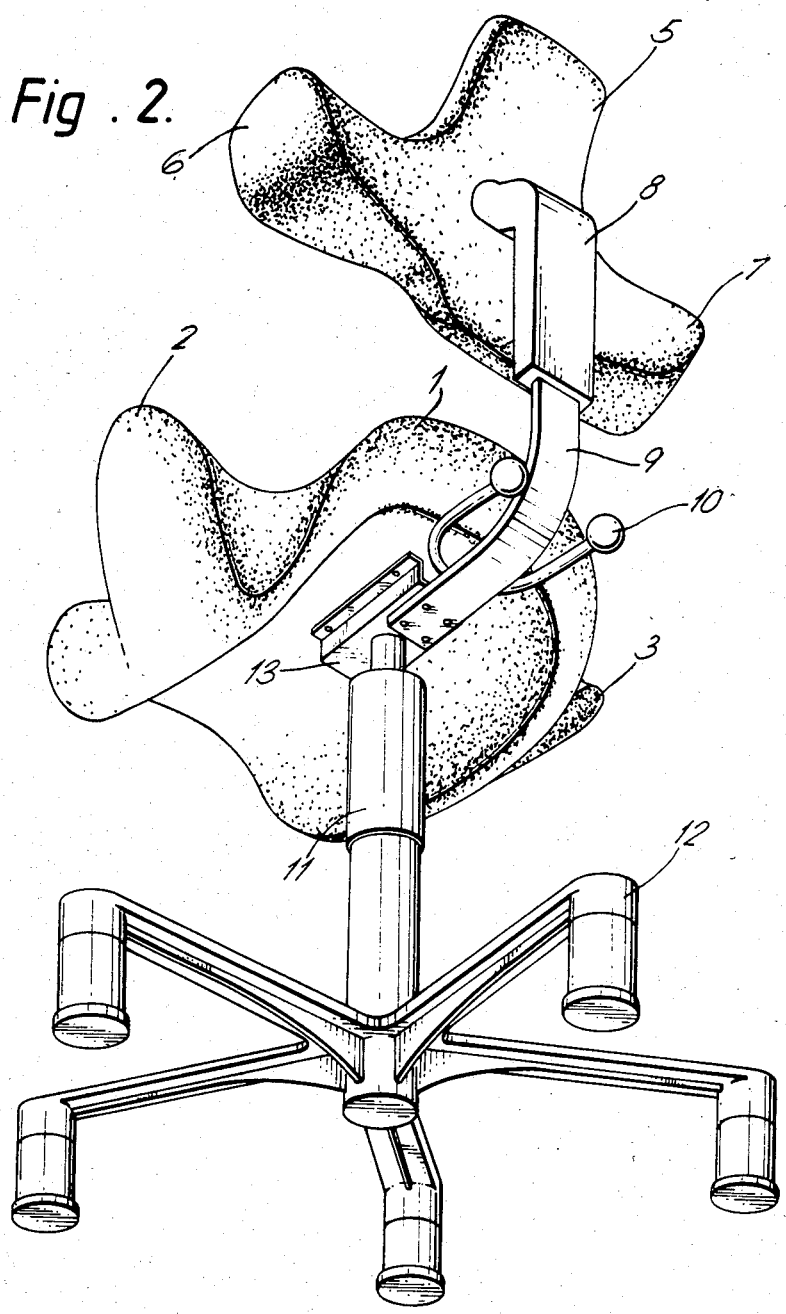
FIG. 2 is a rear perspective view from below of the chair.

As indicated in FIG. 2, the mutual levelwise distance between the back rest of the chair and the seat may be adjusted by means of an adjustment device 8, 9, known per se, said adjustment device at its lower portion extending down to the bottom side of the chair seat 1 and there being fixedly attached to a mounting bracket 13.

The seat and the back rest are thereby connected to the subframe 12 of the chair through a supporting column 11, which may be adjustable in a step-free fashion, in order that the level of the seat thereby can be controlled in a manner known per se. A release handle 10 is made available for this purpose. The chair is thus easily adaptable to users having different body sizes, e.g. as regards legs and upper portion of the body.

As indicated in FIG. 1, the saddle may in the longitudinal direction be slightly curved in an upward direction at the front. The saddle-like transverse members 2 and 3 may also be slightly curved upward. The distance between the end points of the transverse member 2, 3 may correspond approximately to the length of the saddle. The members 2, 3 will, in the illustrated, non-limitative embodiment at their respective tops have a lesser radius of curvature than that of the saddle 1.

Figure 4:
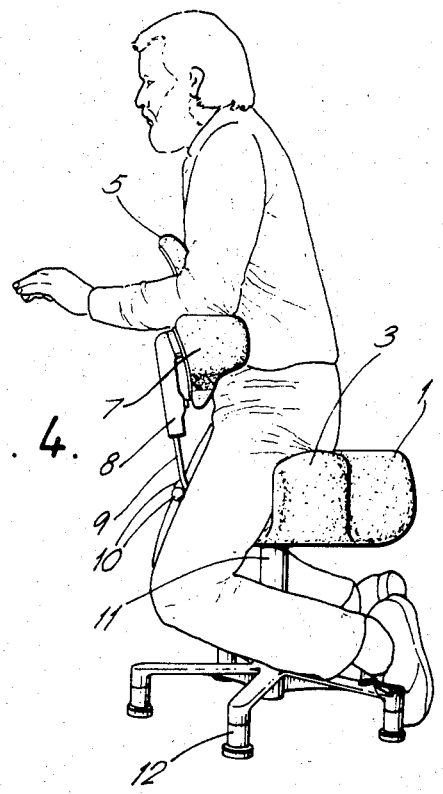
FIG. 4 illustrates the use of the chair with the chair occupant facing in rearward direction.

As appears from FIG. 4, the mid portion 5 will upon forward leaning of the upper part of the body serve partly as chest support. Again, the members 2, 3 of the seat will provide support for the rear side of the chair occupant thighs.

It is readily understood that within the scope of the invention, it will be possible to modify the chair illustrated in FIGS. 1 and 2 without departing from the inventive concept. Thus, the back rest of the chair is illustrated with a mid portion having a width approximately equal to ⅓ of the largest widths of the back rest, but it is immediately understood that the width of this mid section easily may be altered as required. As a possible modification, it may be visualized that the said mid portion 5 extending above the branches 6, 7 is reduced or even removed.

It is also to be understood that the chair occupant may sit sideways, the main saddle body 1 thereby constituting the support for the thigh rear portions of the chair occupant, with the chair occupant riding on one of the seat transverse members 2 or 3, with one arm being able to rest on the support 6 or 7, respectively.

Within the scope of the invention, it is also to be understood that the subframe of the inventive chair can be of any suitable configuration, and that the subframe as illustrated is in no way meant to limit the scope of the present invention.

I claim:

1. A chair having a seat wherein said seat has a longitudinal saddle shaped part, said saddle shaped part having an upper surface cross-section approximately in the shape of an inverted U, and further having saddle-like members projecting transversely out from a mid portion of each longitudinal side of said seat part to support the rear, upper thigh portion of a user of the chair.

2. The chair according to claim 1, wherein a distance between outer ends of said projecting members approximately corresponds to a length of said saddle shaped part.

3. The chair according to claim 1, wherein said projecting members have at a top thereof a curvature of lesser radius of curvature than a curvature of said saddle shaped part.

4. The chair according to claim 2, wherein said projecting members have at a top thereof a curvature of lesser radius of curvature than a curvature of said saddle shaped part.

5. The chair according to claim 1, wherein said seat as viewed from above is shaped substantially like a groin vault.

6. The chair according to claim 1, wherein said seat as viewed from above has a shape substantially like a welsh underpitch vault.

7. The chair according to claim 2, wherein said seat as viewed from above is shaped substantially like a groin vault.

8. The chair according to claim 2, wherein said seat as viewed from above has a shape substantially like a welsh underpitch vault.

9. A chair having a seat and a backrest wherein said seat has a longitudinal saddle shaped part, said saddle shaped part having an upper surface cross-section approximately in the shape of an inverted U, and further having saddle-like members projecting transversely out from a mid portion of each longitudinal side of said seat part to support the rear upper thigh portion of the chair user.

10. The chair according to claim 9, wherein said backrest has a comparatively narrow upright mid portion and two branches extending laterally therefrom.

11. The chair according to claim 10, wherein said mid portion has a width which is approximately equal to one-third of the largest width of said backrest.

12. The chair according to claim 10, wherein said backrest has substantially the shape of a plus sign.

13. The chair according to claim 9, wherein a distance between outer ends of said projecting members approximately corresponds to a length of said saddle shaped part.

14. The chair according to claim 10, wherein said projecting members have at a top thereof a curvature of lesser radius of curvature than a curvature of said saddle shaped part.

15. The chair according to claim 13, wherein said projecting members have at a top thereof a curvature of lesser radius of curvature than a curvature of said saddle shaped part.

16. The chair according to claim 10, wherein said seat as viewed from above is shaped substantially like a groin vault.

17. The chair according to claim 10, wherein said seat as viewed from above has a shape substantially like a welsh underpitch vault.

18. The chair according to claim 13, wherein said seat as viewed from above is shaped substantially like a groin vault.

19. The chair according to claim 13, wherein said seat as viewed from above has a shape substantially like a welsh underpitch vault.

20. A chair having a seat of generally a saddle shape, having a saddle-like member projecting transversely out from a mid portion of each longitudinal side of seat to support the rear, upper thigh portion of a user of the chair, a distance between either ends of said projecting members approximately corresponding to a length of said saddle shaped part, said projecting members, having at their top a curvature of lesser radius of curvature than that of said seat.

* * * * *